US005133546A

United States Patent [19]

Matherne et al.

[11] Patent Number: 5,133,546

[45] Date of Patent: Jul. 28, 1992

[54] FOLDABLE BASKETBALL GAME APPARATUS AND METHOD

[75] Inventors: Lonny R. Matherne, Ogden; Robert W. Adams, Kaysville, both of Utah

[73] Assignee: Lifetime Products, Inc., Clearfield, Utah

[21] Appl. No.: 644,929

[22] Filed: Jan. 23, 1991

[51] Int. Cl.[5] ..... A63B 63/08

[52] U.S. Cl. ..... 273/1.5 A; 273/397

[58] Field of Search ..... 273/1.5 R, 1.5 A, 394, 273/396, 397, 400, 26 R, 26 A; 108/131, 133; 272/101-103

[56] References Cited

U.S. PATENT DOCUMENTS

| | | | |
|---|---|---|---|
| D. 284,599 | 7/1986 | Cochran | D21/201 |
| 1,574,201 | 2/1926 | Lynch | 273/1.5 R |
| 2,534,067 | 12/1950 | Rubin | 273/1.5 R |
| 2,617,653 | 11/1952 | Keller | 273/1.5 R |
| 2,895,737 | 7/1959 | Blees | 273/26 A |
| 3,544,110 | 12/1970 | Dickinson | 273/1.5 R |
| 3,918,711 | 11/1975 | Zak | 273/26 A |
| 4,291,885 | 9/1981 | Cohen | 273/347 |
| 4,735,392 | 4/1988 | Farmer | 108/133 |
| 4,747,597 | 5/1988 | Kluczny | 273/1.5 R |
| 4,786,371 | 11/1988 | Postol | 273/1.5 A |
| 4,805,917 | 2/1989 | Cochran et al. | 273/397 |
| 4,838,549 | 6/1989 | Woodall | 273/1.5 A |
| 4,946,139 | 8/1990 | Tomellini | 273/102 |

FOREIGN PATENT DOCUMENTS

| | | | |
|---|---|---|---|
| 275764 | 8/1927 | United Kingdom | 272/103 |

*Primary Examiner*—Paul E. Shapiro
*Assistant Examiner*—Steven B. Wong
*Attorney, Agent, or Firm*—Craig J. Madson; L. Craig Metcalf; Charles L. Roberts

[57] ABSTRACT

An arcade-type foldable basketball game apparatus upon which games may be played using a basketball is provided, having a framework with a support portion and an extended portion pivotally connected to the support portion so that the extended portion is movable between an upright, storage position and a recumbent, ready-to-play position. The support portion is configured to maintain an upright disposition independent of whether the extended portion is disposed in the upright position or the recumbent position. The movement of the extended portion is controlled by a releasable catch and detent assembly for securing the extended portion in either the storage position or the ready-to-play position. One or two basketball goals are connected to the support portion of the framework and a ball return is connected to said framework to return basketballs shot at the goals by players to the players. Each basket scored is counted by a scoring mechanism which displays the time remaining in a game and the running and final scores.

39 Claims, 4 Drawing Sheets

FOLDABLE BASKETBALL GAME APPARATUS AND METHOD

FIELD OF THE INVENTION

The present invention relates to a basketball game apparatus used for entertainment and the development of basketball shooting skills, and more particularly to an arcade-style home basketball game for one or two players.

BACKGROUND OF THE INVENTION

Because of the popularity of the sport of basketball, particularly in the United States, many people, especially families mount a basketball goal on their property. This allows them ready access to a basketball goal to enjoy the sport of basketball. However, most such basketball goals are mounted outdoors on a garage, on a pole near a driveway or street, or some similar mounting. Thus, during inclement weather or at times when the family vehicle is parked in the driveway, access to the basketball goal may be blocked, impeded, or even prevented.

Heretofore, the ability to take aspects of the game of basketball indoors has been impractical and space prohibitive for most families. Although competitive basketball is truly an indoor sport played traditionally during the winter months, such basketball is usually played in large arenas or gymnasiums. It is not practical to construct a basketball court within a home because of the size of such courts and the height of the basketball goal. Most homes do not have fifteen foot ceilings or the unobstructed floor space needed for a court.

Due to the popularity of the game of basketball and the skill involved to play the game well, games derivative from basketball have developed. Games to test a player's basketball shooting skills are among the most popular at amusement parks, carnivals, and fairs. Typically, a player is given a certain number of shots to score a predetermined number of baskets in order to win a prize. Usually an attendant is present to administer the game and distribute the prizes. Such games are usually outdoors, large, and not intended to be readily mobile.

In more recent years, there has been a trend to scale down the size of such basketball shooting games so that the game could move indoors into arcades. Such arcade games are typically coin-operated and permit the player a designated period of time to score as many baskets as possible. Prizes or additional playing time may be awarded to the particularly skillful player who scores a predetermined number of baskets or points within the time period allowed. Such arcade games have become very popular, finding their way into bars, pizza parlor and other places of amusement and entertainment.

Although arcade games of this type have been used in homes, generally such arcade basketball shooting games are not found within a home. This is because, heretofore, such arcade-style basketball shooting game devices were not intended for and do not address the limitations presented by home usage. Most homes have a very limited floor space and relatively low ceilings. The basketball shooting arcade games that are known are deployed in a ready-to-play configuration that consumes valuable floor space. If a person wishes to reduce the amount of floor space used by the apparatus of the game, virtual disassembly is required.

One known arcade basketball shooting game apparatus has uprights which are capable of folding to a horizontal position, this reduces the height of the game to floor level, but does not address the amount of floor space used. Once folded down into a horizontal position, the apparatus can be leaned against a wall to reduce the amount of floor space used. However, such deployment for storage when not in use is impractical and unsafe. It is a major project to break down the component parts of the game so that the uprights can be folded horizontal, and the project is no less major to unfold the uprights and reposition the components before the device is ready for play. Furthermore, the device when folded down and leaned against a wall for storage is susceptible to tipping over onto children or pets that may jar the device inadvertently.

Heretofore, no known device has been adaptable for indoor home usage while still providing an arcade-type basketball game. Hence, it would be an improvement to provide an arcade type basketball game device that is easily foldable for storage and may be rapidly deployed into its ready-to-play configuration.

Additionally, it would be an improvement to provide a foldable arcade-type basketball game device which stores in a substantially vertical disposition resting on a stable base, thereby minimizing the amount of floor space occupied when the game is not in use.

It would be a further improvement to provide a foldable arcade-type basketball game device which can be transformed rapidly from its vertical storage disposition to its ready-to-play configuration without disassembly of any of its component parts, particularly if such transformation procedure is simple and safe enough to be performed by a child.

Still another improvement would be to provide an arcade-type basketball game device which is adjustable to various different heights to accommodate ceiling heights within homes. Such height adjustability also facilitates skill level adjustability for small children who would otherwise be unable to play or have great difficulty playing if the basket were positioned at its highest height.

Yet another improvement would be to provide an arcade-type basketball game device which is height adjustable without removing or disassembling the basketball backboard connection to the framework of the device.

It would be a further improvement to provide an arcade-type basketball game device which has two side-by-side basketball goals enabling head-to-head basketball shooting competition.

Still another improvement would be to provide an arcade-type basketball game device which electronically registers the score and visually displays a running score while simultaneously visually counting down the period of time during which made shots are counted. Another improvement would be to provide volume-adjustable audible acknowledgement of each basket scored.

Yet another improvement would be to provide an arcade-type basketball game device with a scoring mechanism which reduces extraneous scoring.

OBJECTS AND BRIEF SUMMARY OF THE INVENTION

In view of the foregoing desirability of an indoor arcade-type basketball game device and the typical space limitations experienced by homeowners, it is a primary object of the present invention to provide an arcade-type basketball game device which is easily foldable for storage and may be rapidly deployed into its ready-to-play configuration.

It is another object of the present invention to provide an apparatus which stores in a substantially vertical disposition resting on a stable base, thereby minimizing the amount of floor space occupied when the game is not in use.

A further object of the present invention is to provide an apparatus which is an attractive and compact arcade-type basketball game device which is mobile and which can be transformed rapidly from its vertical storage disposition to its ready-to-play configuration without disassembly of any of its component parts, and where the transformation procedure is simple and safe enough to be performed by a child.

Another object of the present invention is to provide an arcade-type basketball game device which is adjustable to various heights to accommodate different ceiling heights within homes.

Still another object of the present invention is to provide an arcade-type basketball game device having height adjustability to address various skill levels of small children who would otherwise be unable to play if the basketball goal were positioned at its highest height.

Yet another object of the present invention is to provide an arcade-type basketball game device which has two side-by-side basketball goal enabling head-to-head basketball shooting competition.

A further object of the present invention is to provide an arcade-type basketball game device which electronically registers and visually displays the score while simultaneously visually counting down the period of time during which made shots are counted and audibly acknowledges each basket scored.

Still another object of the present invention is to provide an arcade-type basketball game device with a scoring mechanism which reduces extraneous scoring.

The foregoing objects are accomplished by an apparatus of the present invention which may be used in most homes to provide entertainment, amusement, and basketball shooting skill development.

The arcade-type basketball game apparatus of the present invention utilizes a foldable framework comprising a support portion and an extended portion which is pivotally connected to the support portion. The support portion of the framework is capable of stable upright disposition independent of the position to which the extended portion is placed and comprises a pair of vertical legs and a pair of prop legs which brace the vertical legs. The extended portion of the framework is movable about its pivotal connection with the support portion between a substantially vertical disposition and a recumbent disposition.

A backboard and basketball goal or goals are attached to the vertical legs so that the plane of the backboard is disposed vertically. If two basketball goals are used, the basketball game apparatus can accommodate two players in head-to-head basketball shooting competition. A ball return is attached to the framework to define a chute providing the return of each basketball shot at the basketball goal or goals. In a preferred embodiment, the ball return is flexible and is attached to the framework such that one end is secured to the vertical legs at what could be termed the head of the framework and the other end is attached to the extended portion at what could be termed the foot of the framework. The bottom of the ball return subtends the basketball goal or goals and inclines from the foot to the head of the framework such that a basketball shot towards one of the basketball goals from the foot of the framework will return to the player at the foot of the framework by rolling down the inclined bottom of the ball return.

The movement of the extended portion of the framework is restricted by a catch and detent assembly. In one preferred embodiment of the present invention, the catch comprises a plate secured to one of the pivotal connections of the extended portion and the support portion of the framework, and the detent is secured to the extended portion so that it engages the plate as the extended portion is moved between its substantially vertical disposition and its recumbent disposition. On the plate are holes located to receive the detent in releasable engagement. For example, one hole, the ready hole, is located on the plate so that it receives the detent and thereby restricts further movement of the extended portion if the extended portion is in its ready-for-play, recumbent position. Another hole, the storage hole, is located on the plate so that it receives the detent and thereby restricts further movement of the extended portion if the extended portion is in its storage mode, disposed substantially vertical. Movement of the extended portion is permitted between the positions described by depressing the detent so that it disengages from the ready hole or the storage hole.

In another embodiment of the present invention, an additional hole, the safety hole, is provided along the path the detent travels and intermediate of the ready hole and the storage hole. This additional hole serves as a safety feature so that the weight of the extended portion and the ball return does not cause the extended portion to crash down when it is being deployed for play. During the movement of the extended portion from its storage position to its ready-for-play position, the detent engages the safety hole restricting further movement until the person deploying the apparatus releases the detent and further lowers the extended portion. In this manner, the likelihood of an undesired crashing of the extended portion to the floor is significantly reduced. Furthermore, the release of the detent in order to raise or lower the extended portion can be performed easily by most children and adults.

Another embodiment of the present invention incorporates a plurality of height adjustable sections to render the basketball game apparatus height adjustable. In this embodiment, the vertical legs of the support portion are configured to receive in seated engagement one or more of the height adjustable sections in a stacked relationship. When tubing is used for the vertical legs, the seated engagement in a stacked relationship can be accomplished by using a single taper swage pole joint as pioneered by Lifetime Products, Inc. of Clearfield, Utah and as described in co-pending United States patent application Ser. No. 07/421,584, incorporated herein by this reference. In order to change the height of the device to accommodate ceiling height tolerances within homes, the user need only add or remove the appropriate size or number of height adjustment sections.

In a further embodiment of the present invention, an electronic scoring mechanism is provided which counts each basket scored, tabulates a running score, counts the time remaining in the game, and displays the time remaining, the running score, and the final score. In addition, the scoring mechanism can provide an auditory acknowledgement of each basket scored, award additional time for play if a score of a predetermined score is achieved, provide comparative running and final scores, and maintain and display the highest score achieved on the apparatus. The scoring mechanism is constructed with known electronic circuitry which is actuated by the movement of an arm connected to a switch. The arm is movable between a ready position and a reactive position and as the arm moves from the ready position to the reactive position it actuates the switch which thereby communicates with the electronic circuitry that a basket has been scored. The arm is disposed to subtend the basketball goal so that any ball of at least a minimum diameter that passes through the basketball goal will engage the arm causing it to move from its ready position to the reactive position as the ball drops to the ball return. The arm is biased to the ready position so that as the ball disengages the arm, it returns from its reactive position to its ready position to await the scoring of another basket. In a preferred embodiment of the arm, the arm is configured with a curvature for receiving the ball. This curvature causes the ball to momentarily settle within the curvature which directs the weight of the ball to a position which will score the basket made. Thus, the curvature enables the tension of the biasing of the arm to be increased which reduces extraneous scoring (i.e., scoring that is caused by a ball striking the arm although the ball did not pass through the basketball goal).

These and other objects and features of the present invention will become more fully apparent through the following description and appended claims taken in conjunction with the accompanying drawings.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the us of the accompanying drawings in which.

DETAILED DESCRIPTION OF THE PREFERRED EMBODIMENTS

Figure 1:
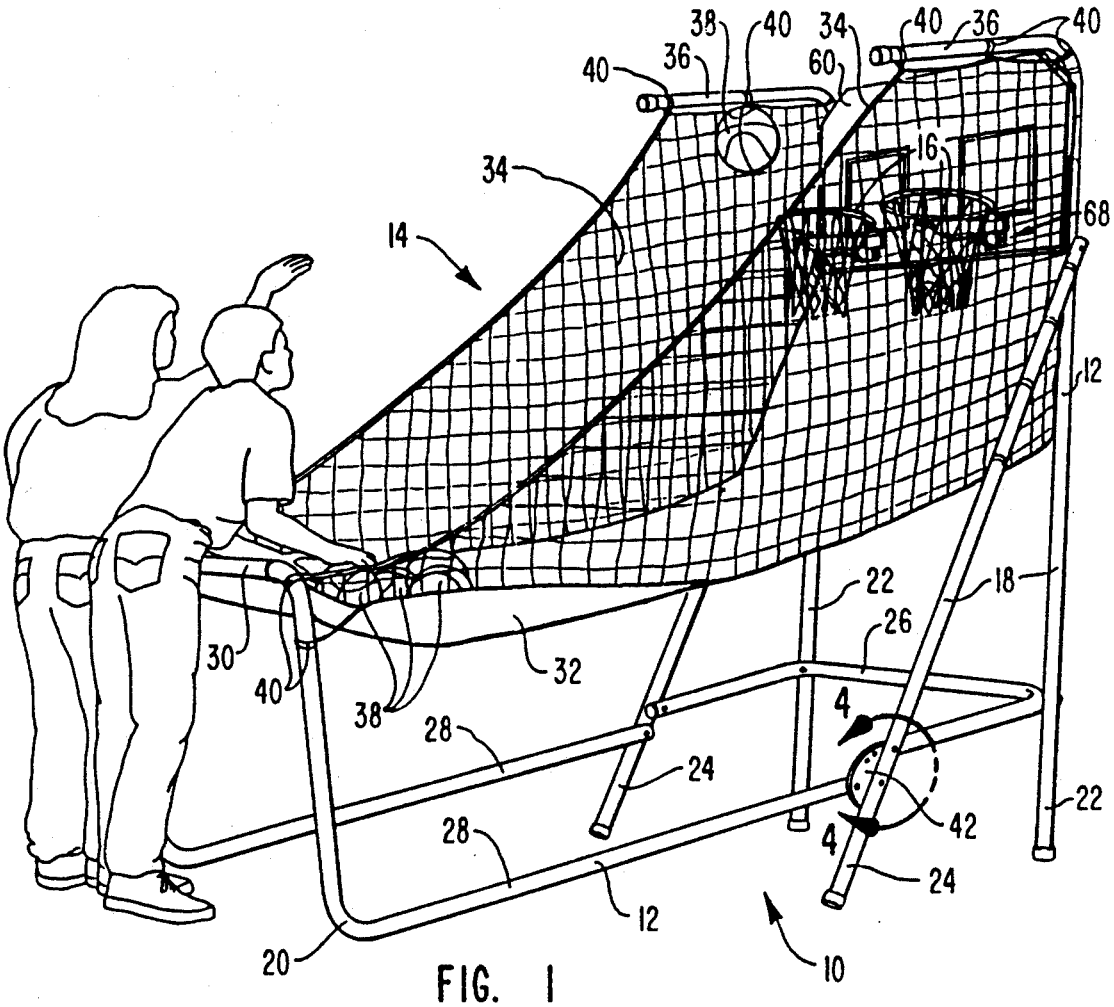
FIG. 1 is a perspective view of the arcade-type basketball game apparatus of the present invention showing the extended portion of the framework deployed in its ready-to-play position and showing two players engaged in head-to-head competition.

Referring now specifically to the drawings, wherein like numerals indicate like parts throughout, the arcade-type basketball game apparatus is generally designated 10. Game apparatus 10 is comprised of a framework 12, a ball return 14, and one or more basketball goals 16.

As shown in FIG. 1, the framework 12 comprises a support portion 18 and an extended portion 20. The support portion 18 is disposed upright resting on a four-point stable base and comprises a pair of substantially vertical legs or members 22, a pair of prop members 24, and a U-shaped brace 26 which are interconnected. Vertical members 22 are braced by the prop members 24 for disposition in a substantially vertical plane, and the U-shaped brace 26 secures the relative positions of the prop members 24 and the vertical members 22 so that the support portion 18 stably rests on a floor or other flat surface.

Figure 2:
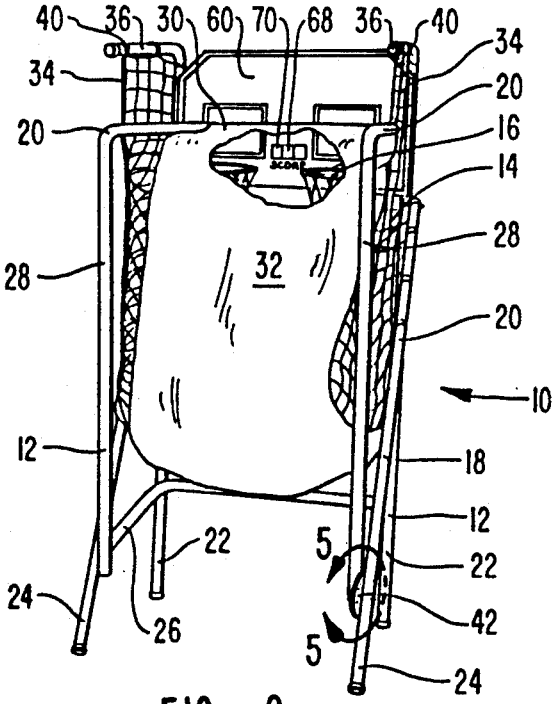
FIG. 2 is a perspective view of the arcade-type basketball game apparatus of the present invention showing the extended portion of the framework deployed in its storage position whereby the ball return forms a pouch within which basketballs can be stored, and also having a portion of the ball return cut away to show a visual display for the scoring mechanism.

The extended portion 20 comprises a pair of legs 28 and a foot 30 therebetween. Each leg 32 is pivotally connected to one of the prop members 24 so that the extended portion 20 is movable about such pivot between a substantially vertical position for storage (as shown in FIG. 2) and a recumbent position for use (as shown in FIG. 1). When in the recumbent, ready-for-play position, the extended portion 20 rests on the floor or other surface and the foot 30 serves to support the ball return 14.

Figure 3:
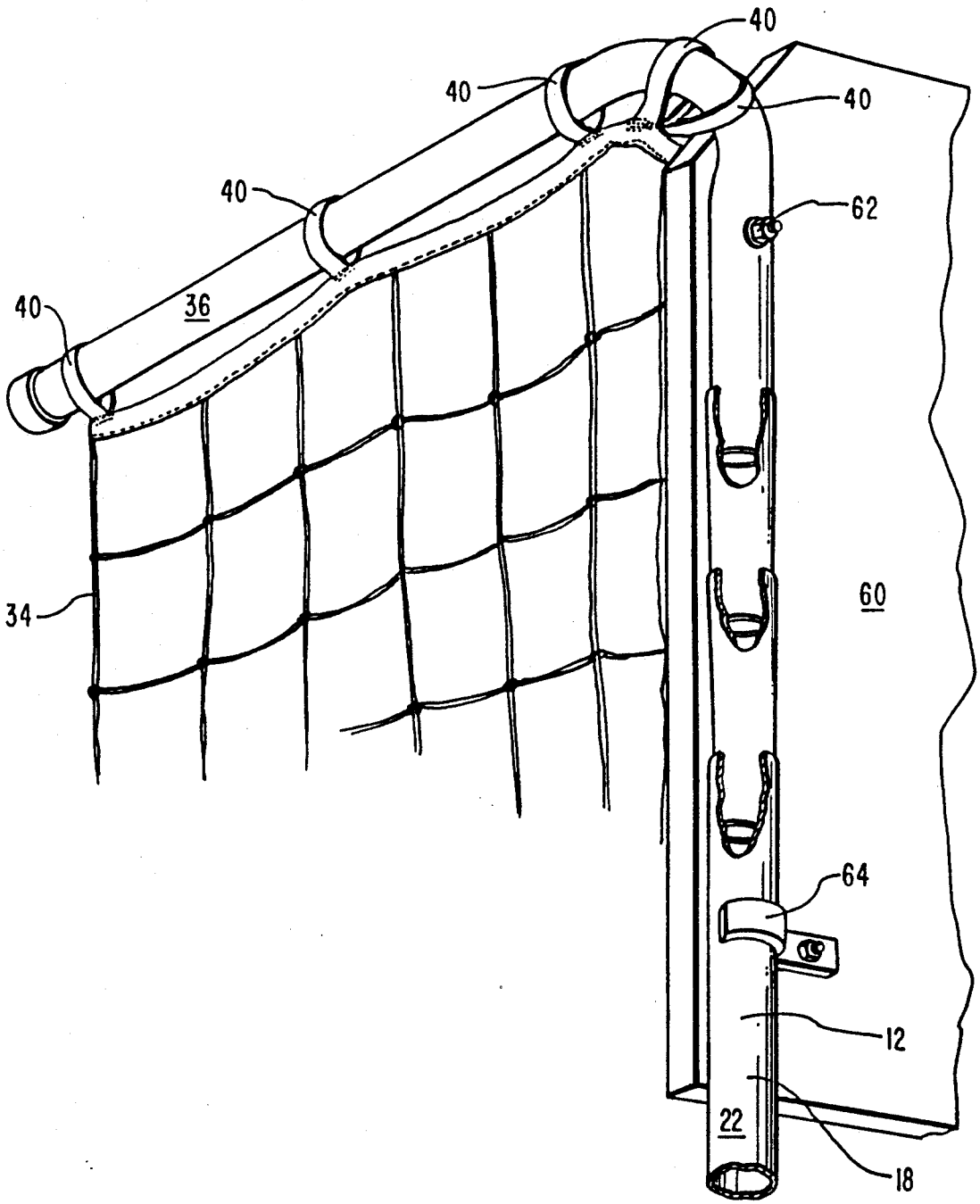
FIG. 3 is a perspective view of a portion of one of the vertical uprights to which the backboard is attached showing the overhang to which the ball return is connected, a partial cutaway view of a plurality of height adjustment sections, and the height adjustment hook clamp.

The ball return 14 is an elongated chute which comprises a bottom 32 and a pair of side walls 34. One end of the ball return 14 (the proximate end) is attached at the head of the framework 12 to the support portion 18 such that the bottom 32 subtends the basketball goals 16 while the side walls 34 extend upwardly. In a preferred embodiment, each vertical member 22 of the support portion 18 has an overhang 36 from which one of the side walls 34 is suspended as shown in FIGS. 1-3. The other end of the ball return 14 (the distal end) is attached at the foot of the framework 12 to the foot 30 such that the bottom 32 generally inclines from the foot of the framework 12 to the head of the framework 12 (See FIG. 1). With this configuration, basketballs 38 that are shot towards the basketball goals 16 generally drop onto the ball return 14 bottom 32, whether the shot is successful or not, and roll back to the foot area of the framework 12 for retrieval and subsequent shots at the goal 16.

Although the ball return 14 may be constructed of any of a number of materials, it is preferred that the bottom 32 be flexible and that the side walls 34 be constructed of a flexible see-through material or netting, and that the means for attaching the ball return 14 to the framework 12 be straps 40 utilizing velcro fasteners. When the bottom 32 and the side walls 34 are flexible, the ball return 14 can double as a storage pouch for the basketballs 38 if the game apparatus 10 is folded as shown in FIG. 2. Additionally, although over time the ball return 14 may stretch or sag somewhat, the straps 40 can be resecured to the framework 12 to adjust for such stretching or sagging.

The game apparatus 10 of the present invention may have one or two basketball goals 16. The basketball goals 16 are secured to the support portion 18 of the framework 12. In the preferred embodiment shown in FIG. 1, two basketball goals 16 are disposed in side-by-side, spaced relationship. This disposition enables two players to engage in simultaneous head-to-head basketball shooting competition with each player shooting at one of the basketball goals 16.

Figure 4:
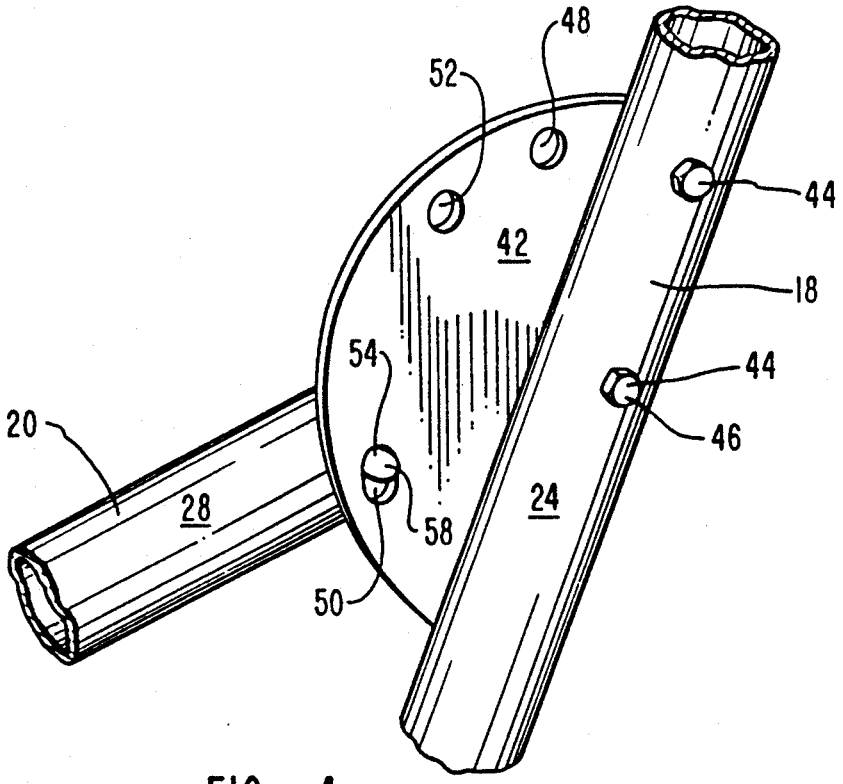
FIG. 4 is a perspective view of the area of the framework identified at arrow 4—4 in FIG. 1 showing the catch plate and detent when the extended portion is deployed in its ready-to-play position.
Figure 5:
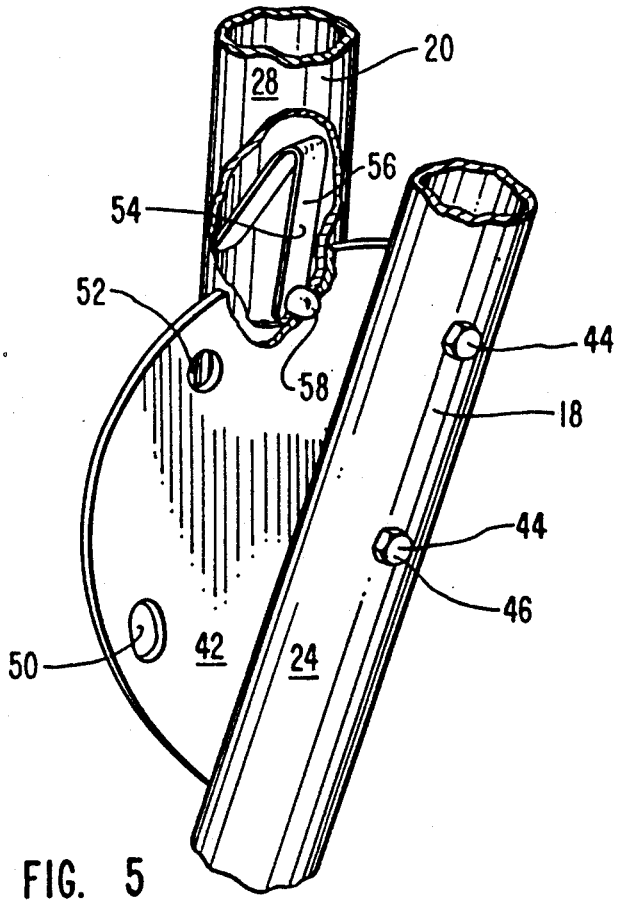
FIG. 5 is a perspective view of the area of the framework identified at arrow 5—5 in FIG. 2 showing the catch plate and detent when the extended portion is deployed in its storage position.

Turning specifically now to FIGS. 4 and 5, at one of the pivots for the extended portion 20 with the support portion 18, a catch plate 42 is provided to restrict the pivotal movement of the extended portion 20. In the preferred embodiment shown, the catch plate 42 is secured to the prop member 24 by bolts 44, one of which serves also as a pivot pin 46 and the leg 28 of the extended portion 20 is pivotally secured to the prop member 24 at the pivot pin 46. The catch plate 42 has a plurality of holes, a storage hole 48, a ready hole 50, and an optional safety hole 52. The leg 28 of extended portion 20 has a detent 54 comprised of a biasing member 56 and a button 58 which engages the catch plate 42 and travels a path along the catch plate 42 as the extended portion 20 moves between its storage and recumbent positions.

The ready hole 50 is located in the catch plate 42 such that the button 58 of the detent 54 engages and enters the ready hole 50 if the extended portion 20 is disposed in its recumbent, ready-for-play position (FIGS. 1 and 4). Hence, the extended portion 20 is restricted from further movement until the button 58 of the detent 54 is depressed sufficiently that the button 58 exits the ready hole 50.

The storage hole 48 is located in the catch plate 42 such that the button 58 of the detent 54 engages and enters the storage hole 48 if the extended portion 20 is disposed in its upright, storage position (FIGS. 2 and 5). The extended portion 20 is restricted from further movement until the button 58 of the detent 54 is depressed sufficiently that the button 58 exits the storage hole 48.

In another preferred embodiment of the present invention, the safety hole 52 is provided which is located on the path that the detent 5 travels and intermediate of the ready hole 50 and the storage hole 48. The purpose of the safety hole 52 is to interrupt the movement of the extended portion 20 from the storage position to the ready-for-play position, so that the extended portion 20 will not crash inadvertently into its recumbent disposition if the person unfolding the game apparatus 10 should lose a proper grip while raising or lowering the extended portion 20.

It should be understood that other types of catches may be used t control and restrict the pivotal movement of the extended portion 20, but the catch plate 42 and detent 54 as described is preferred because it can be operated rapidly and safely, even by a child.

With the embodiments of the present invention as described above, it should be readily understood that game apparatus 10 can be stored in an upright disposition which minimizes the amount of floor space it occupies. Additionally, the mobility of the game apparatus 10 is enhanced when so disposed thereby permitting easy relocation and easy cleaning beneath the game apparatus 10. Further, the game apparatus 10 can be deployed from its storage disposition to its ready-for-play disposition merely by releasing the extended portion 20 by depressing the button 58 and lowering the extended portion 20 until the button 58 engages the ready hole 50. After play is completed, the game apparatus 10 can easily be folded for storage by merely releasing the extended portion 20 by depressing the button 58 and lifting the extended portion 20 until the button 58 engages the storage hole 48.

It is preferred that the basketball goals 16 be secured to a single backboard 60 which is secured to the head of the framework 12 such that the plane of the backboard 60 is substantially vertical. As shown in FIG. 3, a preferred means for attaching the backboard 60 to the vertical members 22 of the framework 12 utilizes an upper bolt 62 and a hook clamp 64. Other means for attachment may be used, but this means enables the height of the game apparatus to be adjusted without removing the backboard 60 from the framework 12 as will be described more fully below.

Since the ceiling tolerances in homes vary, it is advantageous for the present invention to be height adjustable. FIG. 3 illustrates a plurality of height adjustment sections 66 that can be used to adjust the height of the game apparatus 10. Each height adjustment section 66 has a flared end and a tapered end to facilitate the seating of the height adjustment sections 66 in a stacked engagement. The tapered end of a height adjustment section 66 can be inserted into a flared end of the vertical member 22 to form a single taper swage joint. By so seating or removing one or more of the height adjustment sections 66 from the connection of the vertical member 22 and the overhang 36, the height of the game apparatus 10 may be adjusted. Furthermore, by merely loosening the upper bolt 62 and the hook clamp 64, height adjustment sections 66 may be inserted or removed thereby adjusting the height of the game apparatus 10 without removing the backboard 60.

An attractive feature of a preferred embodiment of the present invention is a scoring mechanism (generally designated 68) which maintains the time and counts the score. The scoring mechanism 68 comprises a visual display 70, an arm 72 and a switch 74. Although it is preferred that the scoring mechanism 68 be electronic and provide certain features, the scoring mechanism could be mechanical or provide different features without departing from the spirit of the invention.

By using electronic circuitry known and readily available, the scoring mechanism 68 can provide a visual display (e.g., an LCD display) which visually counts down time remaining in the game, displays running scores (for one or two players), displays the final scores (for one or two players) at the conclusion of the game, and maintains the highest score achieved for display after each game. Additionally, the scoring mechanism 68 can provide non-visual features such as awarding extra time for play if a predetermined score is achieved, giving volume-adjustable auditory acknowledgement for each basket scored, giving different auditory signals for baskets scored on different basketball goals 16, and providing automatic shut-off features.

Figure 6:
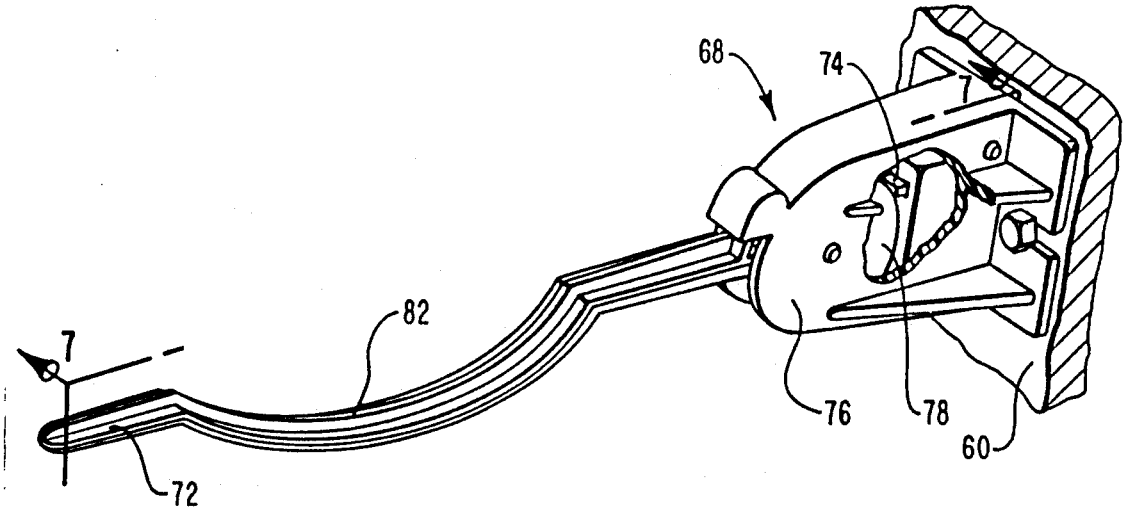
FIG. 6 is a perspective view of the basket counter assembly partially cut away to show the cam and switch.
Figure 7:
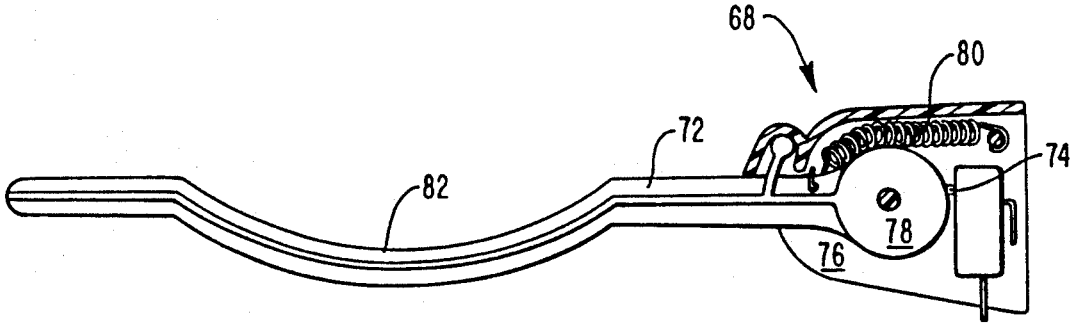
FIG. 7 is a sectional view of the basket counter assembly along line 7—7 showing the extending arm disposed in its ready position.
Figure 8:
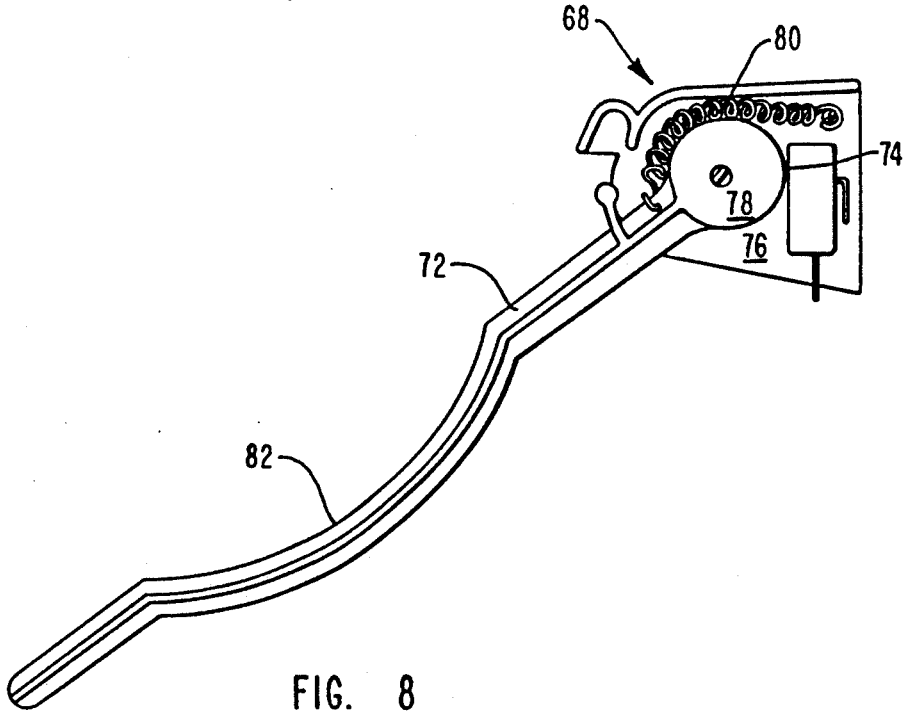
FIG. 8 is a sectional view of the basket counter assembly showing the extending arm disposed in a reactive position.

In FIGS. 6 through 8, the arm 72 and switch 74 of a preferred embodiment of the scoring mechanism 68 of the present invention are illustrated. The arm 72 is pivotally connected to a bracket housing 76 such that under force it can move between a ready position (FIG. 7) and a reactive position (FIG. 8). At the pivoting end of the arm 72 is a cam 78 which engages and actuates the switch 74 as the arm 72 passes from the ready position to the reactive position. The switch 74 which communicates with the electronic circuitry of the scoring mechanism 68, signals the electronic circuitry that a basket has been scored. The score is then tabulated and displayed on the visual display 70. When the force on the arm 72 is released, a biasing spring 80 returns the arm 72 from the reactive position to the ready position and the switch 74 is reset awaiting another basket to be scored.

The arm 72 is disposed to subtend the basketball goal 16 so that any ball 38 of at least a minimum diameter that passes through the basketball goal 16 will engage the arm 72. The weight of the ball 38 and the force at which it strikes the arm 72 causes the arm 72 to move from its ready position to the reactive position as the ball 38 drops to the ball return 14. This actuates the switch 74 which signals the electronic circuitry which, in turn, displays the new score. Since the arm 72 is biased to the ready position, as the ball 38 disengages the arm 72, the arm 72 returns from its reactive position to its ready position to await the scoring of another basket.

In a preferred embodiment of the arm 72, the arm 72 is configured with a curvature 82 for receiving the ball 38. This curvature 82 urges the ball 38 to momentarily settle within the curvature 82 thereby directing the weight of the ball 38 to a position which will assure that the arm 72 will move to the reactive position, scoring the basket made. The curvature 82 enables the tension of the biasing of the arm 72 to be increased s that a threshold force is required to move the arm 72 sufficiently to score a basket. Balls 38 striking the arm 72 at an improper angle (having not passed through a basketball goal 16) will not usually cause the arm 72 to move sufficiently to actuate the switch 74. Hence, the curvature 82 of the arm 72 serves to reduce extraneous scoring.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A portable foldable basketball game apparatus upon which games may be played using a basketball, comprising:

a framework having a support portion and an extended portion, said support portion of said framework comprising a substantially vertical member and a prop member connected to and bracing said substantially vertical member so that said support portion is supported in an upright disposition upon a base portion of said substantially vertical member and said prop member, said extended portion being pivotally connected proximate to said base portion of said prop member and being movable between a first position and a second position, and said support portion being configured to maintain its upright disposition independent of whether said extended portion is disposed in the first position or the second position;

releasable means disposed at the pivotal connection of said prop member and said extended portion for securing said extended portion in the first position if said extended portion is disposed in the first position and for securing said extended portion in the second position if said extended portion is disposed in the second position;

a basketball goal connected to said substantially vertical member in a position remote and elevated from said base portion of said substantially vertical member; and a ball return connected to said framework.

2. A foldable basketball game apparatus as set forth in claim 1, wherein the first position is when said extended portion is disposed in a substantially upright disposition so that the basketball game apparatus is in a nonuse, storage mode.

3. A foldable basketball game apparatus as set forth in claim 1, wherein the second position is when said extended portion is dispose din a recumbent disposition so that the basketball game apparatus is deployed in a ready-for-play mode.

4. A foldable basketball game apparatus as set forth in claim 3, wherein said ball return comprises:

an elongated bottom portion having a proximate end connected to said support portion and subtending said basketball goal and a distal end connected to said extended portion such that if said extended portion is deployed in the second position said bottom portion inclines from its distal end to its proximate end; and a pair of side walls each connected along opposite side edges of said bottom portion between its proximate end and its distal end, thereby defining a chute for the return of basketballs.

5. A foldable basketball game apparatus as set forth in claim 4, wherein said bottom portion and said side walls are flexible such that if said extended portion is dispose din the first position, said ball return folds forming a pouch within which basketballs may be stored while the basketball game apparatus is not in use.

6. A foldable basketball game apparatus as set forth in claim 4, wherein said support portion further comprises a pair of overhang members from which at least a portion of one of said side walls is suspended from each overhang member.

7. A foldable basketball game apparatus as set forth in claim 1, wherein said releasable means for securing said extended portion comprises:

a catch connected to said prop member of said support portion; and a detent connected to said extended portion for engaging said catch in releasable engagement.

8. A foldable basketball game apparatus as set forth in claim 7, wherein said catch comprises a plate with a plurality of holes each capable of receiving said detent in releasable engagement, said holes disposed at predetermined locations on said plate, one of said holes being disposed such that said detent engages such hole if said extended portion is in the first position, thereby releasably securing said extended portion in the first position.

9. A foldable basketball game apparatus as set forth in claim 7, wherein said catch comprises a plate with a plurality of holes each capable of receiving said detent in releasable engagement, said holes disposed at predetermined locations on said plate, one of said holes being disposed such that said detent engages such hole if said extended portion is in the second position, thereby releasably securing said extended portion in the second position.

10. A foldable basketball game apparatus as set forth in claim 7, wherein said catch comprises a plate With a plurality of holes each capable of receiving said detent in releasable engagement, said holes disposed at predetermined locations on said plate, one of said holes serving as a safety hole being disposed such that said detent engages such safety hole if said extended portion is disposed intermediate of the first position and the second position, thereby releasably securing said extended portion intermediate of the first position and the second position and impeding the movement of said extended portion between the first position and the second position.

11. A foldable basketball game apparatus as set forth in claim 1, wherein said substantially vertical member comprises a plurality of removable height adjustment sections and the height of the basketball game apparatus is adjustable by removing or replacing, once removed, one or more of said height adjustment sections.

12. A foldable basketball game apparatus as set forth in claim 11, further comprising:

a backboard connected to said substantially vertical member such that the plane of said backboard is disposed substantially vertical, said basketball goal being secured to said backboard; and a means for securing the connection of said backboard to said substantially vertical member.

13. A foldable basketball game apparatus as set forth in claim 12, wherein said means for securing the connection of said backboard to said substantially vertical member comprises a hook clamp which permits, upon the loosening of said hook clamp, the height of the basketball game apparatus to be adjusted by removing or replacing height adjustment sections.

14. A foldable basketball game apparatus as set forth in claim 1, wherein the basketball game apparatus comprises two basketball goals connected to said support structure, said basketball goals disposed in side-by-side, spaced relationship, thereby enabling head-to-head basketball shooting competition on the basketball game apparatus.

15. A foldable basketball game apparatus as set forth in claim 1, further comprising adjustable straps connected to said ball return for securing said ball return to said framework.

16. A foldable basketball game apparatus as set forth in claim 1, further comprising a scoring mechanism for displaying the score of the game during play and at the conclusion of play.

17. A foldable basketball game apparatus as set forth in claim 16, wherein said scoring mechanism comprises a means for visual display connected to said support portion and disposed near said basketball goal; and a basket counter assembly connected to said support portion and disposed such that at least a portion of which subtends said basketball goal.

18. A foldable basketball game apparatus as set forth in claim 17, wherein said scoring mechanism comprises a timer and said means for visual display displays the amount of time remaining in each game as such game is being played.

19. A foldable basketball game apparatus as set forth in claim 17, wherein said means for visual display displays a running score as each game is being played and a final score at the conclusion of each game.

20. A foldable basketball game apparatus as set forth in claim 17, wherein the basketball game apparatus comprises two basketball goals connected to said support structure, said basketball goals being disposed in side-by-side, spaced relationship, and said means for visual display displays comparative running scores as each game is being played and a final comparative score at the conclusion of each game.

21. A foldable basketball game apparatus as set forth in claim 17, wherein said basketball counter assembly comprises:

a switch for counting scores during play; and a rigid arm movable between a ready position and a reactive position, said arm being in actuating communication with said switch, and said arm extending such that a substantial portion thereof subtends said basketball goal whereby each ball of predetermined diameter which passes through said basketball goal engages said arm causing it to move from the ready position to the reactive position thereby actuating said switch to count a score in the game.

22. A foldable basketball game apparatus as set forth in claim 21, wherein said arm is configured with a curvature for receiving a ball of predetermined diameter in momentary engagement.

23. A foldable basketball game apparatus as set forth in claim 16, wherein said scoring mechanism comprises means for providing an auditory signal each time a ball of predetermined diameter passes through said basketball goal during the time period for playing the game.

24. A foldable basketball game apparatus as set forth in claim 16, wherein the basketball game apparatus comprises two basketball goals connected to said support structure, said basketball goals being disposed in side-by-side, spaced relationship, and said scoring mechanism comprises means for providing distinct auditory signals corresponding to each basketball goal each time a ball of predetermined diameter passes through either of said basketball goals during the time period for playing the game.

25. A portable basketball game apparatus upon which games may be played using a basketball, comprising:

a framework having a support portion and an extended portion, said support portion of said framework comprising a substantially vertical member and a prop member connected to and bracing said substantially vertical member so that said support portion is supported in an upright disposition, said extended portion being connected to said prop member of said support portion, said substantially vertical member of said support portion comprises a plurality of removable height adjustment sections and the height of the basketball game apparatus is adjustable by removing or replacing, once removed, one or more of said height adjustment sections;

a basketball goal;

a backboard connected to said substantially vertical member of said support portion such that the plane of said backboard is disposed substantially vertical, said basketball goal being secured to said backboard;

a means for securing the connection of said backboard to said support portion; and a ball return connected to said framework.

26. A basketball game apparatus as set forth in claim 25, wherein said means for securing the connection of said backboard to said support portion comprises a hook clamp which permits, upon the loosening of said hook clamp, the height of the basketball game apparatus to be adjusted by removing or replacing height adjustment sections.

27. A basketball game apparatus as set forth in claim 25, wherein the basketball game apparatus comprises two basketball goals connected to said support structure, said basketball goals disposed in side-by-side, spaced relationship, thereby enabling head-to-head basketball shooting competition on the basketball game apparatus.

28. A basketball game apparatus as set forth in claim 25, wherein said support portion further comprises a plurality of overhang members from which at least a portion of said ball return is suspended from each overhang member.

29. A portable basketball game apparatus upon which games may be played using a basketball, comprising:

a foldable framework having a support portion with a base portion which supports said support portion in an upright disposition and an extended portion movably connected to said support portion proximate to said base portion;

a basketball goal;

a backboard connected to said support portion such that the plane of said backboard is disposed substantially vertical and said backboard is spaced from where said extended portion is connected to said support portion, said basketball goal being secured to said backboard;

a means for securing the connection of said backboard to said support portion;

a ball return connected to said framework; and a scoring mechanism for displaying the score of the game during play and at the conclusion of play comprising:

a means for visual display connected to said support portion and disposed near said basketball goal;

a switch for counting sores during play; and a rigid arm movable between a ready position and a reactive position, said arm being in actuating communication with said switch, and said arm extending such that a substantial portion thereof subtends said basketball goal whereby each ball of predetermined diameter which passes through said basketball goal engages said arm causing it to move from the ready position to the reactive position thereby actuating said switch to count a score in the game.

30. A basketball game apparatus as set forth in claim 29, wherein said means for visual display displays the amount of time remaining in each game as such game is being played.

31. A basketball game apparatus as set forth in claim 29, wherein said means for visual display displays a running score as each game is being played and a final score at the conclusion of each game.

32. A basketball game apparatus as set forth in claim 29, wherein the basketball game apparatus comprises two basketball goals connected to said support structure, said basketball goals being disposed in side-by-side, spaced relationship, and said means for visual display displays comparative running scores as each game is being played and a final comparative score at the conclusion of each game.

33. A basketball game apparatus as set forth in claim 29, wherein said scoring mechanism comprises means for providing an auditory signal each time a ball of predetermined diameter passes through said basketball goal during the time period for playing the game.

34. A basketball game apparatus as set forth in claim 29, wherein the basketball game apparatus comprises two basketball goals connected to said support structure, said basketball goals being disposed in side-by-side, spaced relationship, and said scoring mechanism comprises means for providing distinct auditory signals corresponding to each basketball goal each time a ball of predetermined diameter passes through either of said basketball goals during the time period for playing the game.

35. A basketball game apparatus as set forth in claim 29, wherein said arm is configured with a curvature for receiving a ball of predetermined diameter in momentary engagement.

36. A method for folding for nonuse and storage in a substantially upright disposition a portable basketball game apparatus having a framework with a support portion and an extended portion pivotally connected to the support portion, a ball return connected to the framework, and a basketball goal connected to the support portion, the extended portion being movable between a first position and a second position, wherein the support portion is configured to maintain an upright disposition independent of whether the extended portion is disposed in the first position or the second position, and further having a releasable means for securing said extended portion in the first position if said extended portion is disposed in the first position and for securing said extended portion in the second position if said extended portion is disposed in the second position, comprising the steps of:

(a) releasing the releasable means to free the extended portion for movement upwardly from the second position to the first position;

(b) moving the extended portion upwardly from the second position to the first position; and (c) engaging the releasable means in releasable engagement to secure the extended portion for disposition in the first position, thereby rendering the basketball game unusable by disposing the ball return t block access to the basketball goal.

37. A method as set forth in claim 36, wherein said basketball game apparatus further comprises a safety means communicating with the releasable means for impeding the movement of the extended portion between the second position and the first position, and the method further comprises the step of disengaging the safety means thereby permitting the extended portion to move to the first position.

38. A method for unfolding for use a portable folded basketball game apparatus having a framework with a support portion and an extended portion pivotally connected to the support portion, a ball return connected to the framework, and a basketball goal connected to the support portion, the extended portion being movable between a first position and a second position, wherein the support portion is configured to maintain an upright disposition independent of whether the extended portion is disposed in the first position or the second position, and a releasable means for securing said extended portion in the first position if said extended portion is disposed in the first position and for securing said extended portion in the second position if said extended portion is disposed in the second position, comprising the steps of:

(a) releasing the releasable means to free the extended portion for movement downwardly from the non-use, first position where the ball return blocks access to the basketball goal to the second position;

(b) moving the extended portion downwardly form the first position to the second position such that the ball return is positioned to return basketballs directed toward the basketball goal; and (c) engaging the releasable means in releasable engagement to secure the extended portion for disposition in the ready-for-play, second position.

39. A method as set forth in claim 38, wherein said basketball game apparatus further comprises a safety means communicating with the releasable means for impeding the movement of the extended portion between the first position and the second position and the method further comprises the step of disengaging the safety means thereby permitting the extended portion to move to the second position.

* * * * *